US007516515B2

(12) United States Patent
Leimkuehler et al.

(10) Patent No.: US 7,516,515 B2
(45) Date of Patent: Apr. 14, 2009

(54) REFRIGERATOR WITH DUAL SWING DOOR

(75) Inventors: Scott W. Leimkuehler, Swisher, IA (US); Chad J. Rotter, Amana, IA (US)

(73) Assignee: Maytag Corporation, Benton Harbor, MI (US)

( * ) Notice: Subject to any disclaimer, the term of this patent is extended or adjusted under 35 U.S.C. 154(b) by 548 days.

(21) Appl. No.: 11/402,973

(22) Filed: Apr. 13, 2006

(65) Prior Publication Data

US 2007/0256447 A1 Nov. 8, 2007

(51) Int. Cl.
*E05D 7/10* (2006.01)

(52) U.S. Cl. ..... 16/231; 16/232; 49/193; 312/324

(58) Field of Classification Search ..... 16/230, 16/231, 233, DIG. 23; 49/193, 382; 312/324, 312/325, 326, 328
See application file for complete search history.

(56) References Cited

U.S. PATENT DOCUMENTS

| | | | | | |
|---|---|---|---|---|---|
| 2,790,992 | A | * | 5/1957 | Campbell | 16/232 |
| 3,281,992 | A | | 11/1966 | Morrison | |
| 3,321,100 | A | | 5/1967 | Toma | |
| 3,889,419 | A | * | 6/1975 | Maleck | 49/193 |
| 4,222,149 | A | | 9/1980 | Holbek | |
| 4,495,673 | A | | 1/1985 | Khan | |
| 4,503,582 | A | | 3/1985 | Gurubatham | |
| 4,503,583 | A | | 3/1985 | Frohbieter | |
| 4,503,584 | A | | 3/1985 | Malchow | |
| 4,947,583 | A | | 8/1990 | Inui et al. | |
| 5,052,151 | A | | 10/1991 | Inui | |
| 5,064,255 | A | | 11/1991 | Inui et al. | |
| 5,133,153 | A | | 7/1992 | Kamitaka | |
| 5,187,836 | A | | 2/1993 | Kim et al. | |
| 5,222,792 | A | | 6/1993 | Kai et al. | |
| 5,548,927 | A | * | 8/1996 | Song | 49/193 |
| 5,675,934 | A | | 10/1997 | Park | |
| 5,829,197 | A | | 11/1998 | Oh | |
| 5,983,453 | A | * | 11/1999 | Miwa | 16/231 |
| 6,085,463 | A | | 7/2000 | Yoshikawa | |
| 6,282,838 | B1 | | 9/2001 | Yoshikawa | |

FOREIGN PATENT DOCUMENTS

| | | |
|---|---|---|
| GB | 2256452 | 6/1991 |
| JP | 402248595 | 10/1990 |
| JP | 404198686 | 7/1992 |

* cited by examiner

*Primary Examiner*—Chuck Y. Mah
(74) *Attorney, Agent, or Firm*—Kirk Goodwin; Michael D. Lafrenz

(57) ABSTRACT

A refrigerator incorporates a dual swing door including a dual hinge mechanism. The dual hinge mechanism includes a lock bar having a first end portion and a second end portion joined by an intermediate portion. Each of the first and second end portions includes first and second lobe elements. The hinge mechanism also includes a hinge plate having a first end section and a second section joined by an intermediate section. Each of the first and second end sections include a wedge member and a rudder member. The hinge plate further includes first and second hinge pins, mounted to corresponding ones of the first and second end sections, that define left and right pivot axes for the door. The rudder and wedge members interact with the first lobes to automatically force one of the second lobes into engagement with a respective hinge pin to establish a desired hinge axis for pivoting of the door.

17 Claims, 10 Drawing Sheets

REFRIGERATOR WITH DUAL SWING DOOR

BACKGROUND OF THE INVENTION

1. Field of the Invention

The present invention pertains to the art of refrigerators and, more particularly, to a refrigerator having a dual swing door.

2. Discussion of the Prior Art

Appliances having dual swing doors, i.e., doors that can be operated from both left and right sides, are known in the art. Typically, a dual swing door includes two sets of hinges, one set positioned along each side portion, allowing the door to pivot about either a left or right hinge axis. The door also includes a trapping member that slides between and traps one set of hinges to establish a pivot axis on a desired side of the door.

The trapping member typically takes the form of a sliding rod or bar that is incorporated into upper and/or lower edge portions of the door. The bar is acted upon by a mechanism that guides the bar into a linkage which, in turn, traps the desired set of hinges. When the door is in a closed position, the bar is shifted into a centered or neutral position. Centering is accomplished through additional linkages and/or springs. While effective, the use of linkages and springs creates a complicated mechanism that increases the complexity and manufacturing costs of the door. Also, the more complex the system, the greater the tendency for the system to fail.

Based on the above, there still exists a need for an enhanced dual swing door mechanism for a refrigerator. More specifically, there exists a need for a dual swing door mechanism that employs a simple hinge mechanism which does not rely upon springs and complicated linkages to allow the door to pivot about multiple axes.

SUMMARY OF THE INVENTION

The present invention is directed to refrigerator having a dual swing door. The refrigerator includes a cabinet shell within which is mounted a liner having top, bottom, rear and opposing side walls that collectively define a fresh food compartment. In accordance with the invention, the dual swing door includes a top edge portion, a bottom edge portion and opposing side edge portions and is pivotally mounted to the cabinet shell through a dual hinge mechanism that selectively allows pivoting of the door about axes defined along the opposing side edge portions.

The dual hinge mechanism employed in the invention includes a lock bar slidably mounted to the bottom edge portion of the door. The lock bar includes a first end portion and a second end portion that are joined by an intermediate portion. Preferably, each end portion includes first and second lobe elements. In addition to the lock bar, the hinge mechanism also includes a hinge plate fixedly mounted to the cabinet shell below the dual swing door. The hinge plate includes a first end section and a second section that are joined by an intermediate section. Each of the end sections includes a wedge member and a rudder member that are arranged so as to interact with the first lobe elements on the lock bar.

In accordance with the most preferred form of the invention, the hinge plate also includes first and second hinge pins that are mounted to corresponding ones of the first and second end sections. The hinge pins define left and right pivot axes for the door. That is, upon pivoting the door about either one of the left and right pivot axes, the first lobe elements on the end portion being shifted engages with the corresponding rudder member to shift the lock bar along the bottom edge portion of the door. As the lock bar shifts, the second lobe element on the end portion opposite the pivot axis interacts with and traps the hinge pin, thereby enabling the door to continue to pivot and expose the fresh food compartment. When the door is closed, the wedge members interact with the first lobe elements to re-center the locking bar.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
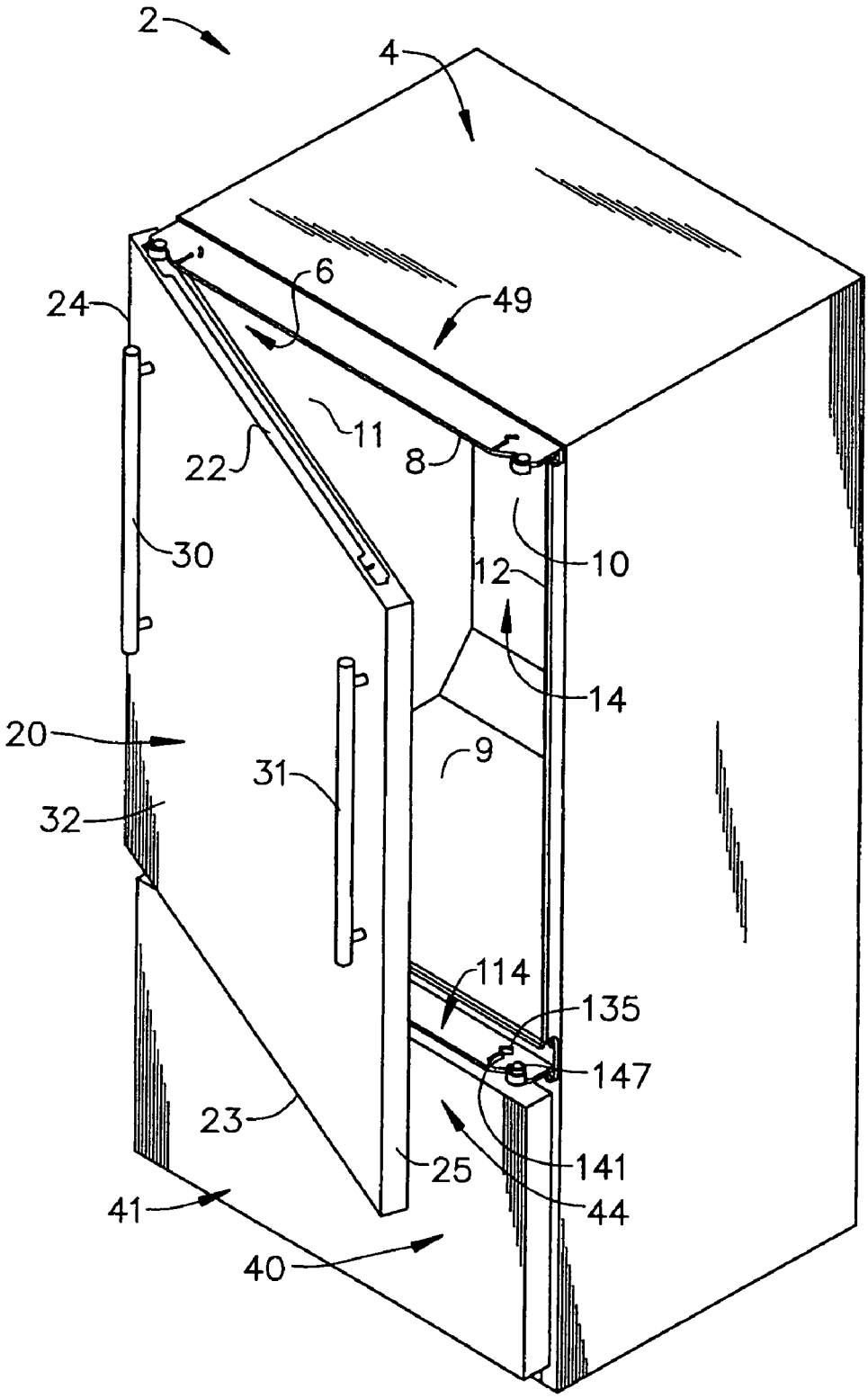
FIG. 1 is an upper right perspective view of a bottom mount refrigerator incorporating a dual swing door constructed in accordance with the present invention.

With initial reference to FIG. 1, a refrigerator, generally indicated at 2, is shown to include a cabinet shell 4 having arranged therein a liner 6. Liner 6 includes top, bottom, rear and opposing side walls 8-12 that collectively define a fresh food compartment 14. A door 20 is pivotally mounted relative to cabinet shell 4 to selectively provide access to fresh food compartment 14. Door 20 is shown to include a top edge portion 22, a bottom edge portion 23 and opposing side edge portions 24 and 25. As will be detailed more fully below, door 20 constitutes a dual swing door that is pivotable about multiple, vertical axes defined along opposing side edge portions 24 and 25. Given that door 20 is pivotal about multiple axes, a pair of handles 30 and 31 are mounted at spaced locations to an outer portion 32 of door 20. Of course, it should be understood that handles 30 and 31 could take on various forms, for example, recesses integrally formed into opposing side edge portions 24 and 25.

In the embodiment shown, refrigerator 2 is constituted by a bottom mount refrigerator. That is, arranged below fresh food compartment 14 is a freezer compartment 40 having a freezer compartment door 41. Freezer compartment door 41 can be pivotal about a vertical axis, or can be mounted to extensible rails that allow door 41 to slide out from freezer compartment 40. Typically, in the slide-out configuration, door 41 is mounted to a basket (not shown) that extends outward from freezer compartment 40 together with freezer door 41. In any event, the above described structure has been provided for the sake of completeness and to enable a better understanding of the drawings and the overall invention.

The present invention is particularly directed to a hinge arrangement that enables door 20 to pivot about multiple axes. Refrigerator 2 includes a first dual hinge mechanism 44 arranged at a lower portion of door 20 and a second dual hinge mechanism 49 arranged at an upper portion of door 20. However, given that, with very few minor exceptions which will be detailed, dual hinge mechanisms 44 and 49 are substantially identical, a detailed description will be made with respect to lower dual hinge mechanism 44 with an understanding that upper dual hinge mechanism 49 is substantially, similarly constructed.

Figure 2:
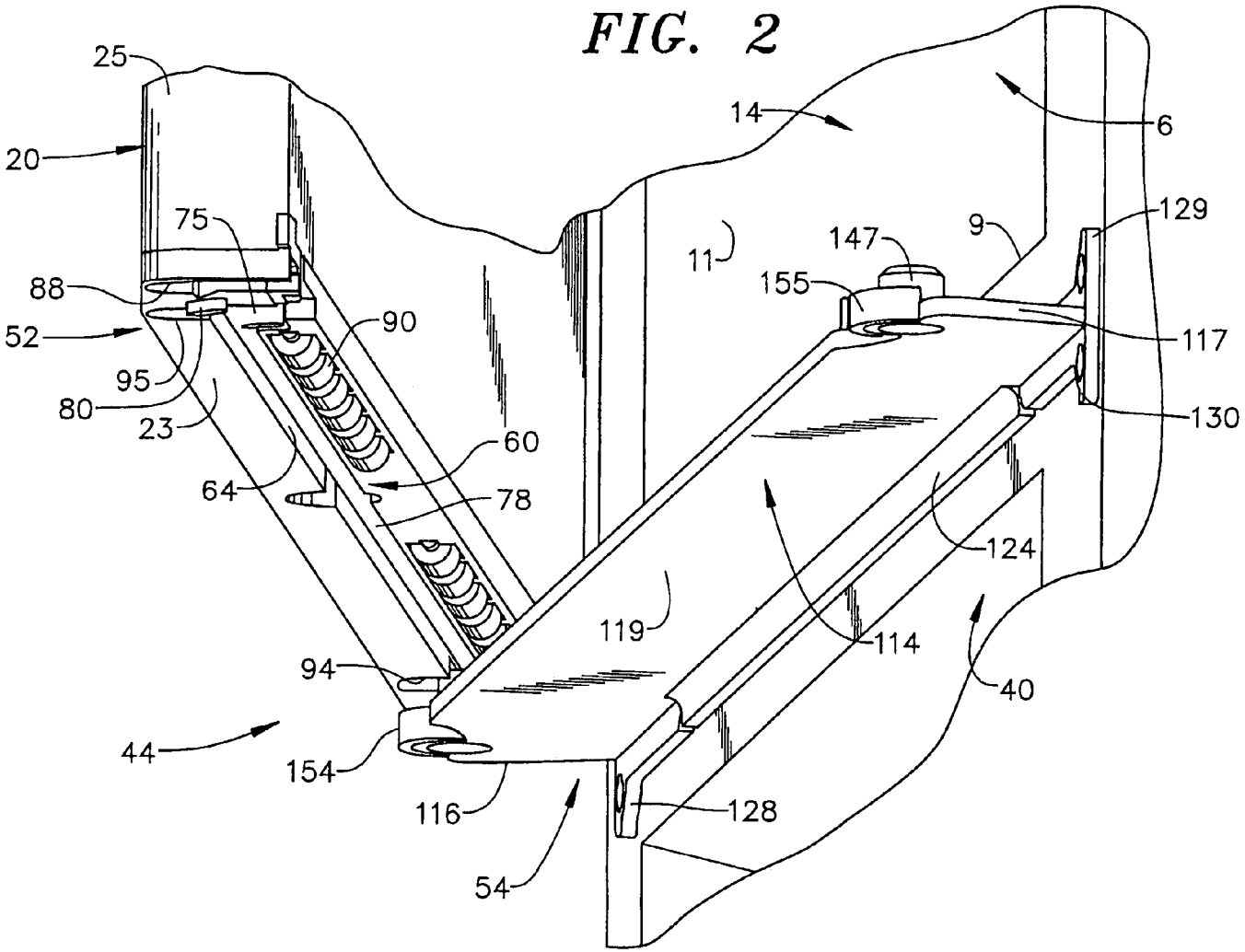
FIG. 2 is a partial, lower perspective view of a dual hinge mechanism of the dual swing door constructed in accordance with the present invention.
Figure 3:
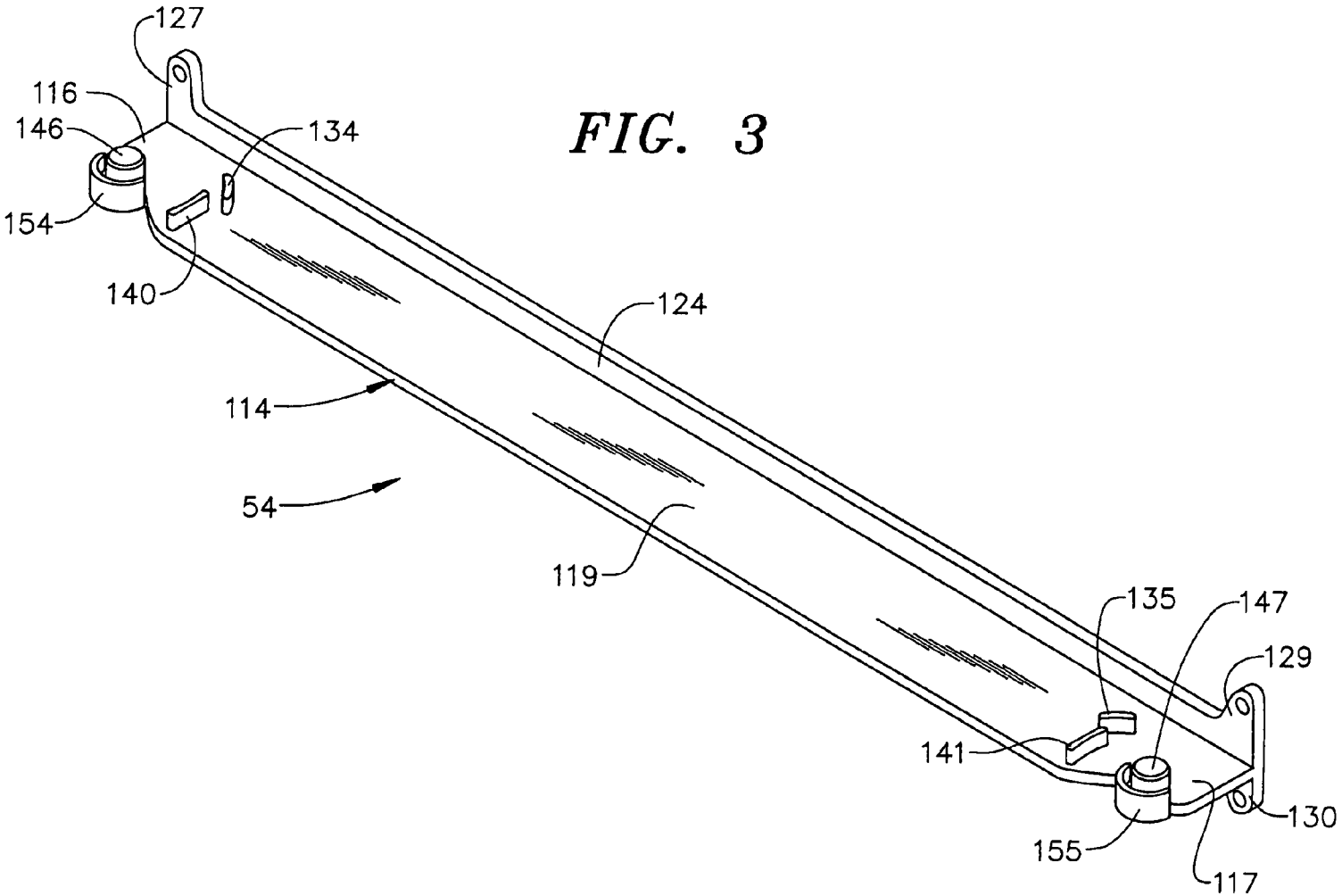
FIG. 3 is an upper right perspective view of a hinge plate portion of the dual hinge mechanism.
Figure 4:
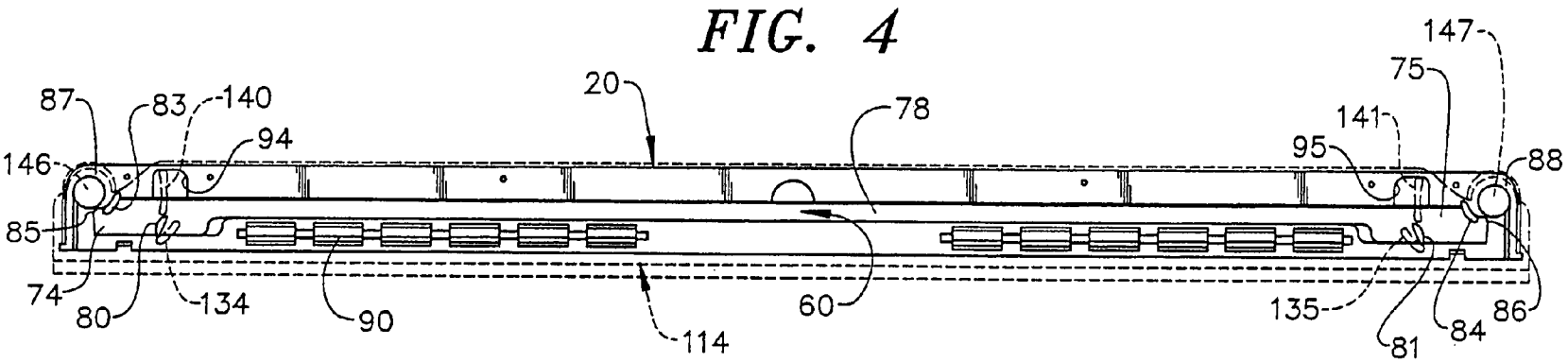
FIG. 4 is a bottom view of a bottom edge portion of the dual swing door in a closed position, with the hinge plate portion shown in phantom.

Referring to FIGS. 2-4, dual hinge mechanism 44 includes a door mounted portion, indicated generally at 52, and a cabinet mounted portion, indicated generally at 54. In accordance with the invention, door mounted portion 52 includes a lock bar 60 slidably mounted within a groove or channel 64 formed in bottom edge portion 23 of door 20. As best shown in FIG. 4, lock bar 60 includes a first end portion 74 that extends to a second end portion 75 through an intermediate portion 78. Each end portion 74, 75 is provided with a respective first lobe element 80, 81, as well as a respective second lobe element 83, 84. Also, each of first and second end portions 74 and 75 includes a rounded or radiused end section 85, 86. In addition to lock bar 60, bottom edge portion 23 includes first and second hinge receivers 87 and 88, as well as a plurality of support rollers, one of which is indicated at 90. Rollers 90 are, in accordance with the embodiment shown, partially recessed within bottom edge portion 23. Of course, it should be understood that, in an alternative arrangement, rollers 90 could be mounted to cabinet mounted portion 54. Bottom edge portion 23 is also formed with a pair of recesses 94 and 95 which, as will be discussed more fully below, cooperate with cabinet mounted portion 54 when door 20 is in a closed position.

As best shown in FIG. 3, cabinet mounted portion 54 is constituted by a hinge plate 114 having a first end section 116 that extends to a second end section 117 through an intermediate section 119. Hinge plate 114 also includes a back section 124 that extends between first and second end sections 116 and 117. Back section 124 is provided with a plurality of mounting ears 127-130 (see both FIGS. 2 and 3) used to mount hinge plate 114 to cabinet shell 4 with mechanical fasteners (not shown).

In further accordance with the invention, hinge plate 114 includes first and second wedge members 134 and 135 provided at first and second end sections 116 and 117 respectively. In addition, hinge plate 114 includes first and second rudder members 140 and 141, also provided at first and second end sections 116 and 117 respectively. Actually, first and second rudder members 140 and 141 are arranged adjacent and angled with respect to first and second wedge members 134 and 135. Finally, hinge plate 114 is shown to include a pair of hinge pins 146 and 147 that are arranged outboard of first and second rudder members 140 and 141 respectively. Hinge pins 146 and 147, together with corresponding hinge pins (shown in FIG. 1 but not separately labeled) arranged on upper dual hinge mechanism 49, establish the pivot axes for door 20. In any case, each hinge pin 146, 147 includes a guide track portion 154, 155 which, as will be discussed more fully below, selectively cooperates with a respective second lobe element 83, 84 to trap the corresponding hinge pin 146, 147, thereby allowing door 20 to transition between an open and closed position.

Having described a preferred construction of dual hinge mechanism 44, reference will now be made to FIGS. 4-10 in describing a preferred method of operation. Initially, it should be noted that the description of the preferred method of operation of dual hinge mechanism 44 will describe door 20 opening about a pivotal axis defined by hinge pin 147. However, it should be understood that door 20 could also pivot about an axis defined by hinge pin 146 without requiring any modifications to door 20 except for the location of force applied to door 20.

Figure 5:
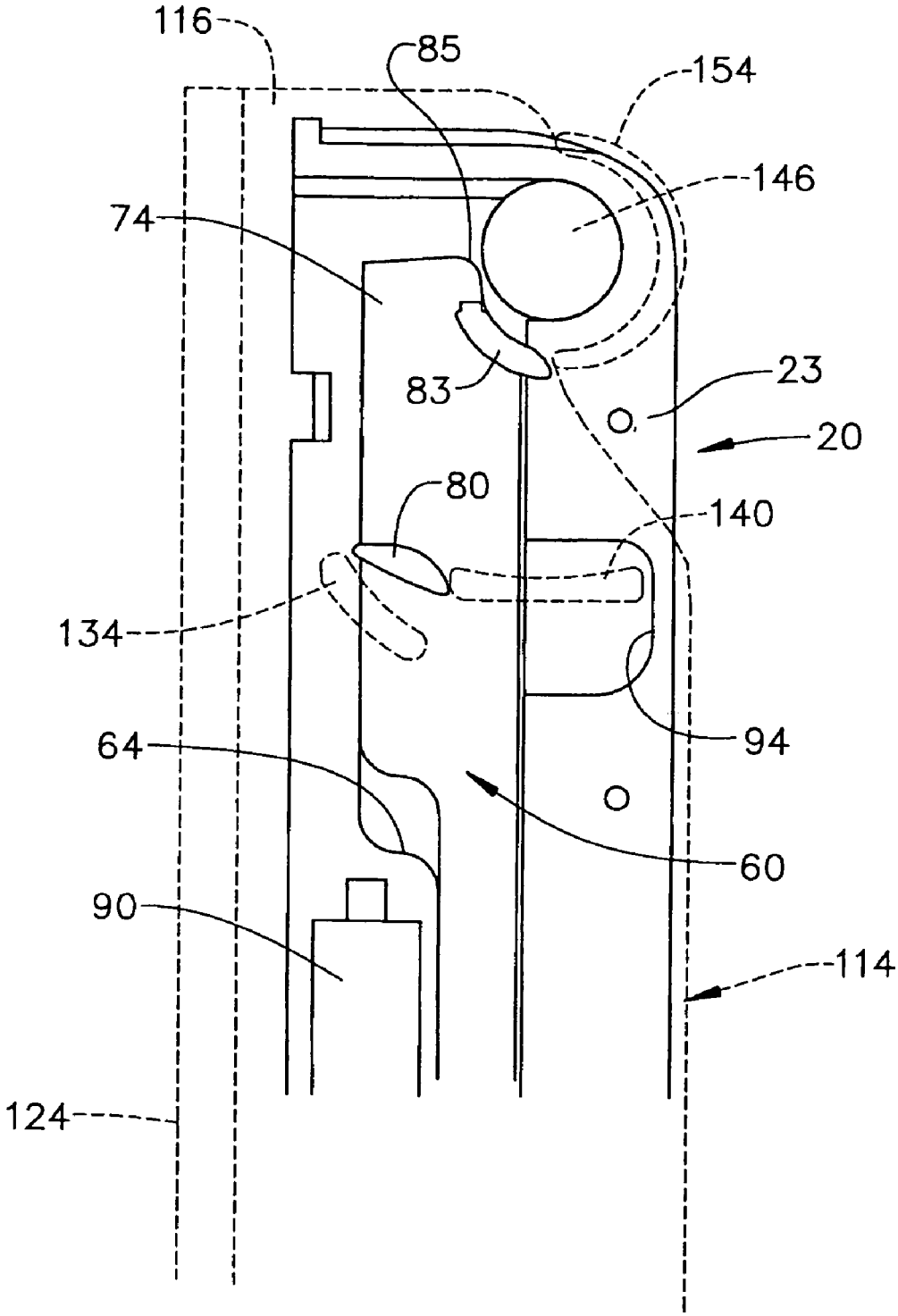
FIG. 5 is a partial, detailed view of a first side section of the dual swing door of FIG. 4, with the dual swing door starting to pivot about an opposing second side section.
Figure 6:
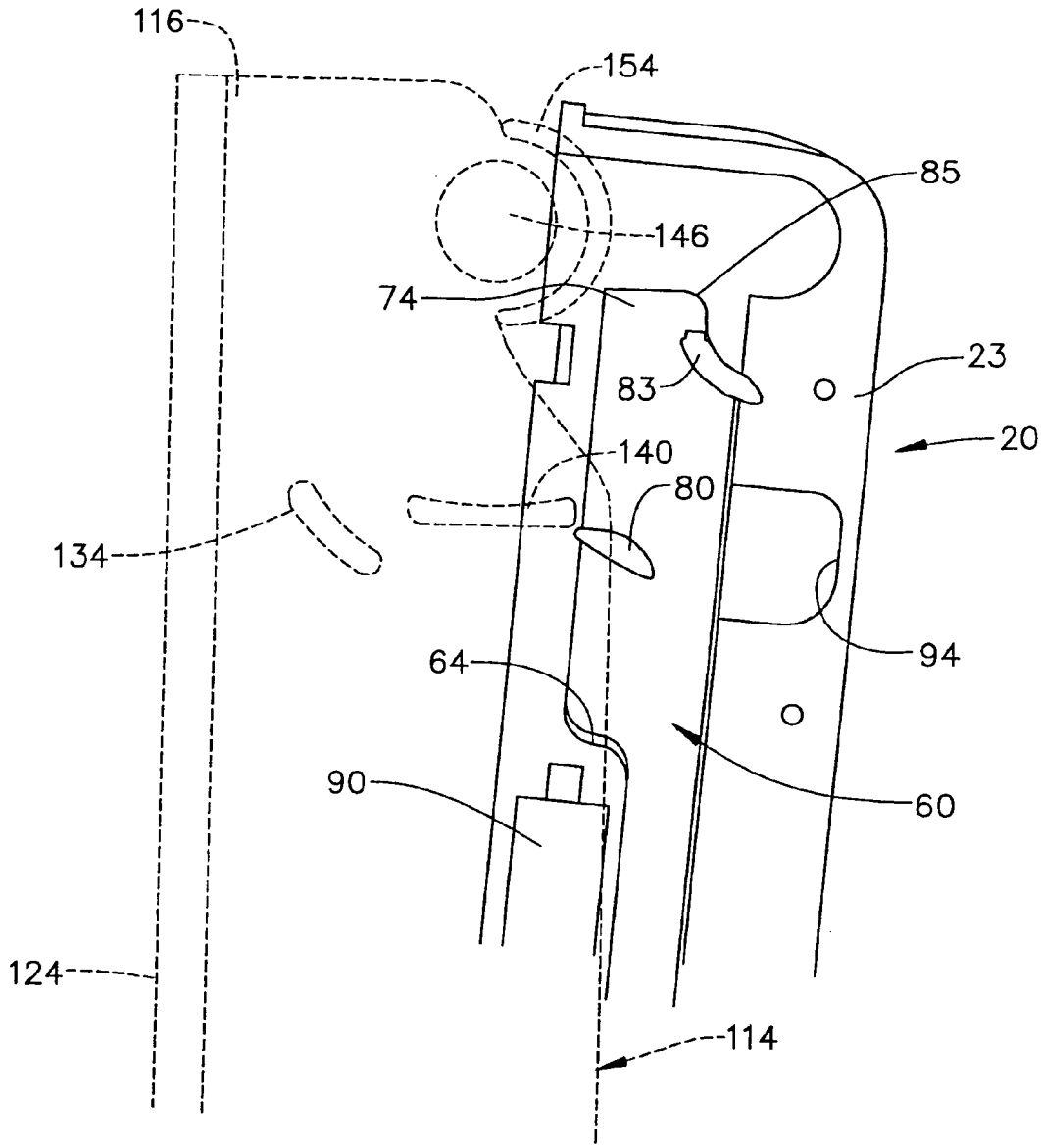
FIG. 6 is a partial detailed view of the first side section of FIG. 5, illustrating the dual swing door shifting to an open position.

As door 20 begins to pivot about hinge pin 147, hinge pin 146 contacts radiused end 85 imparting an initial movement to lock bar 16. As door 20 continues to open, first lobe element 80 on first end portion 74 of lock bar 60 contacts first rudder member 140 on hinge plate 114 and second lobe element 83 interacts with guide track portion 154 as shown in FIG. 5. Minimal rotation or pivoting of door 20, generally in the order of a few degrees of rotation, causes lock bar 60 to be constrained by the interaction of rudder member 140 with first lobe element 80 and second lobe element 83 with guide track 154. As door 20 continues to pivot about hinge pin 147, first lobe element 80 interacts with rudder member 140 causing lock bar 60 to shift within channel 64 towards hinge pin 147. More specifically, when the rotation of door 20 exceeds approximately 25° as represented in FIG. 6, lobe element 80 clears rudder member 140 and locking is accomplished by the interaction between second lobe element 84 and guide track portion 155 in a manner that will be discussed more fully below. It should also be noted that, during the initial stages of opening door 20, rollers 90 move along intermediate section 119 of hinge plate 114. Rollers 90 provide support to door 20 to prevent any cocking of hinge mechanisms 44 and/or 49 that might interfere with the proper operation of door mounted portion 52.

Figure 7:
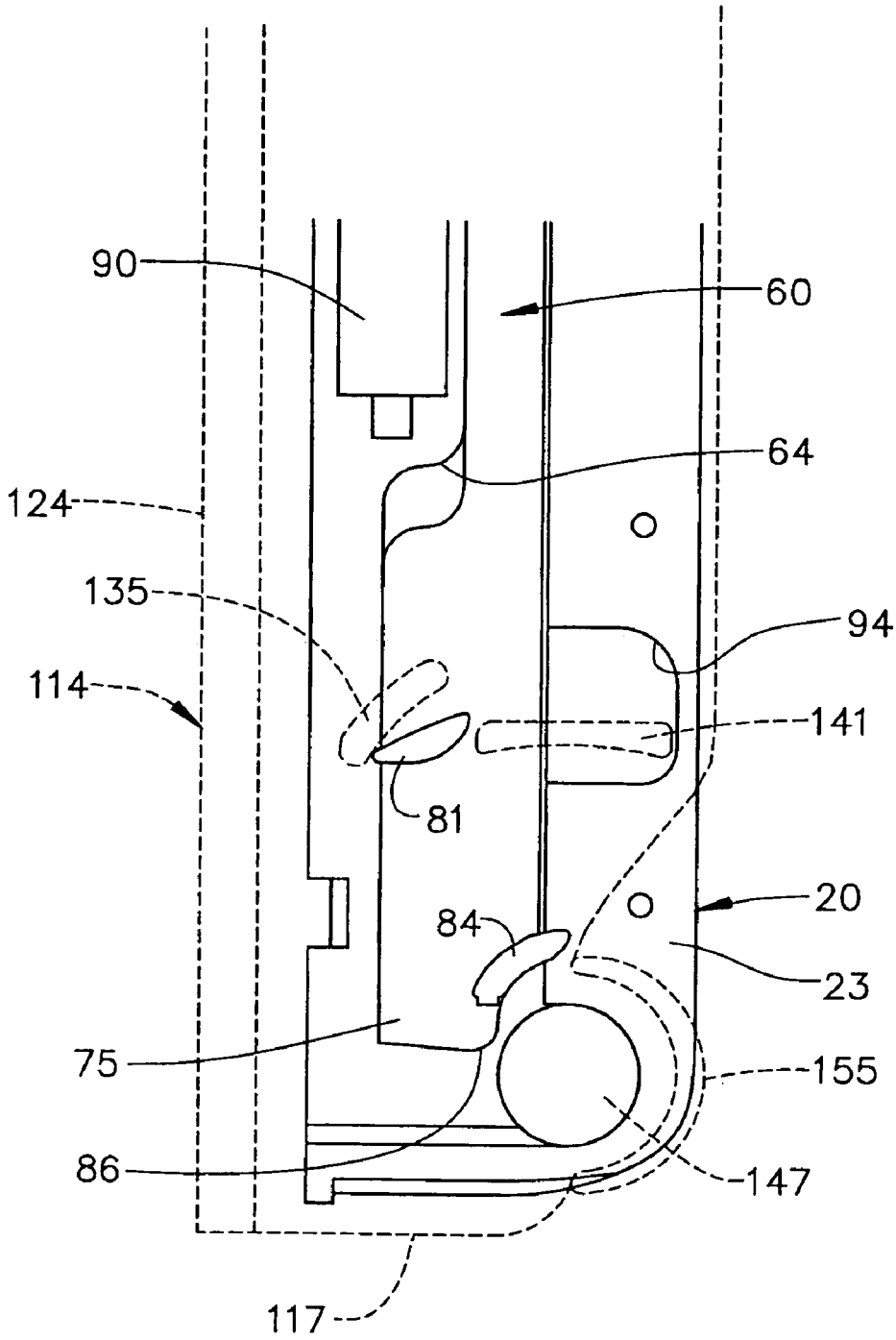
FIG. 7 is a partial detailed view of the second side section of the dual swing door of FIG. 4, with the door shown in a closed position.
Figure 8:
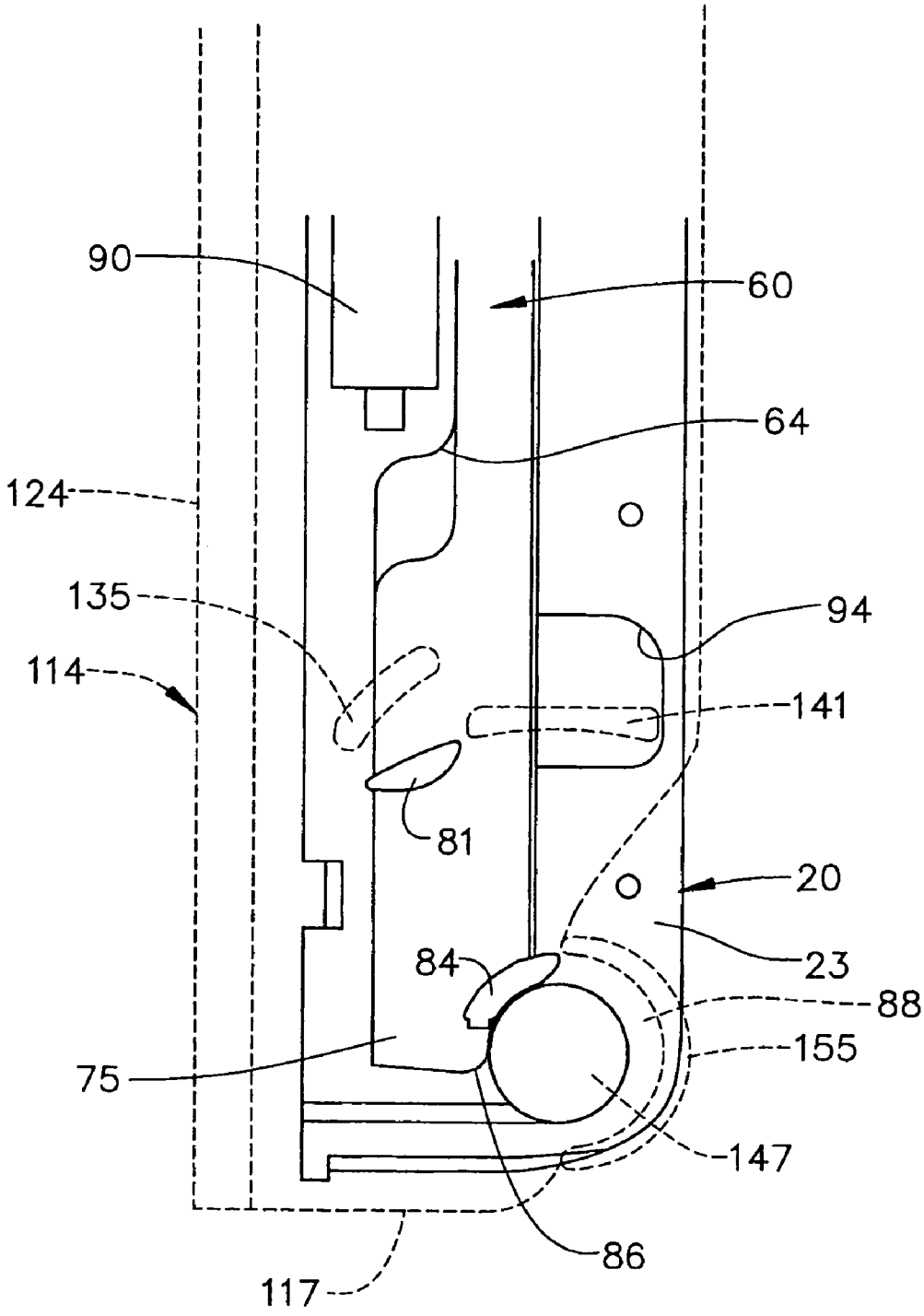
FIG. 8 is a partial detailed view of the second side section of FIG. 7 illustrating the dual swing door just starting to move to an open position.
Figure 9:
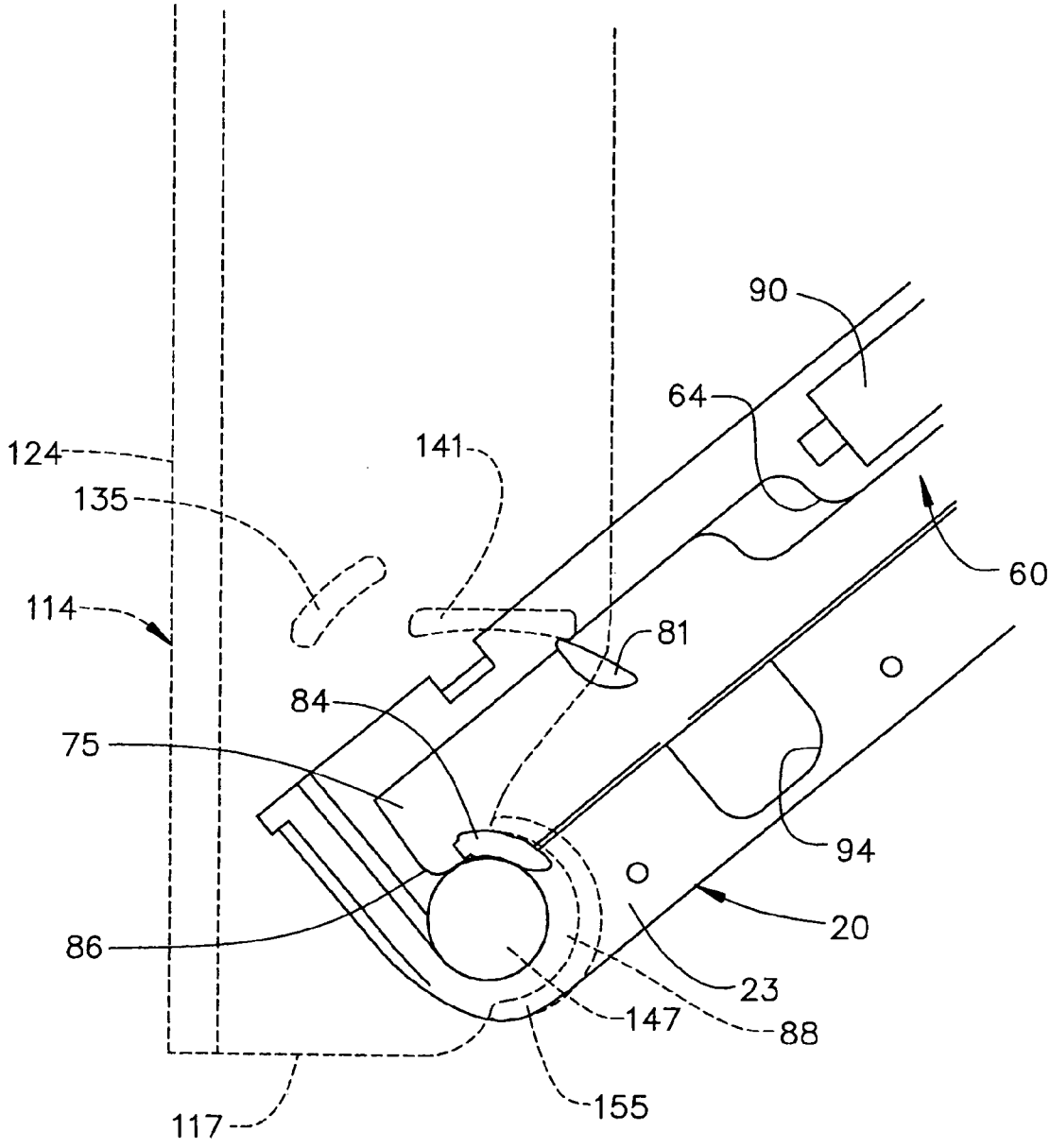
FIG. 9 is a partial detailed view of the second side section of FIG. 8 showing the dual swing door moving further towards an open position.
Figure 10:
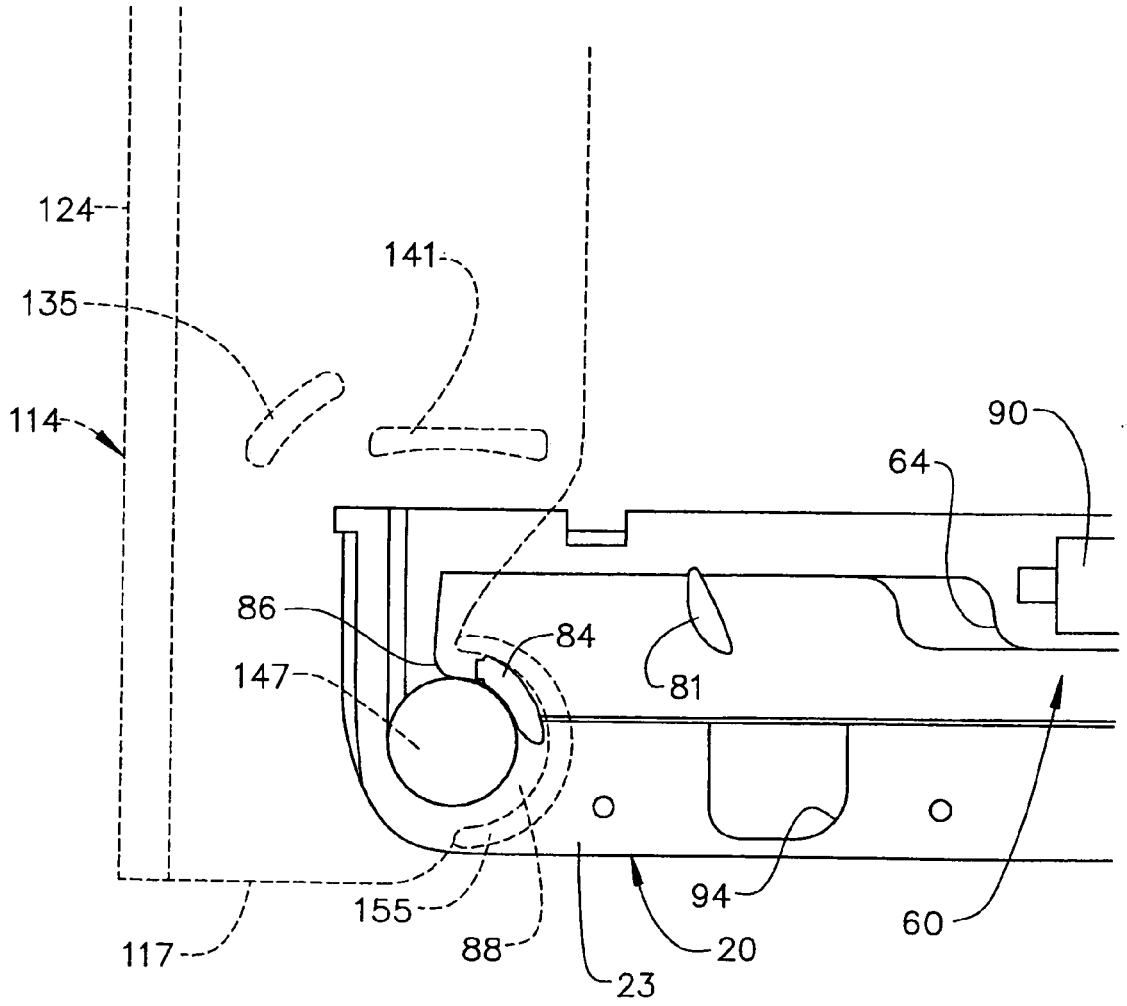
FIG. 10 is a partial detailed view of the second side section of FIG. 8 illustrating the dual swing door moving still further open.

When door 20 is in a closed position, lock bar 60 is centered within groove 64 as represented in FIGS. 4 and 7. However, as discussed above, once door 20 begins to pivot about hinge pin 147 (FIG. 5), hinge pin 146 contacts radiused end 85 imparting an initial movement to lock bar 60. As door 20 continues to open, additional movement is imparted to lock bar 60 through interaction of second lobe element 83 with guide track portion 154 and first lobe element 80 with rudder member 140. Lock bar 60 shifts within groove 64, second end portion 75 is caused to move closer to hinge pin 147 as represented in FIG. 8. With continued pivoting of door 20, lock bar 60 is constrained by the interaction of second rudder member 141 and first lobe element 81 until door 20 achieves an opening angle of 25° (see FIG. 9). At this point, second lobe element 84 is already positioned between hinge pin 147 and guide track portion 155 locking or trapping hinge pin 147 in hinge pin receiver 88 enabling door to pivot freely as represented in FIGS. 9 and 10.

When door 20 is moved to the closed position, first lobe elements 80 and 81 abut first and second wedge members 134 and 135 causing lock bar 60 to re-center within groove 64. More specifically, first lobe element 80 abuts and travels along rudder 140 until contacting wedge member 134. Given the curvature of wedge member 134, first lobe element 80 is forced laterally outwardly, causing lock bar 60 to shift in channel 64. This shifting causes first lobe element 81 to abut wedge member 135 and, upon further closing of door 20, first lobe element 81 to ride along wedge member 135 which automatically centers lock bar 60. With lock bar 60 being re-centered, door 20 is again free to pivot about either hinge pin 146 or 147.

While not shown, it should be understood that upper dual hinge mechanism 49 functions in a manner corresponding to that described above. That is, upper dual hinge mechanism 49 includes all of the components of lower hinge mechanism 44 except for rollers 40. Based on the above discussion, it should be understood that the present invention advantageously provides a dual hinge mechanism that enables a refrigerator door to pivot about multiple axes without requiring complicated and failure-prong linkages or springs. In this manner, the present invention provides a simple, cost effective method of enabling a door of an appliance to be selectively pivoted about multiple axes.

Although described with reference to a preferred embodiment of the invention, it should be readily understood that various changes and/or modifications can be made to the invention without departing from the spirit thereof. For instance, while shown in connection with a bottom mount refrigerator, the present invention could easily be incorporated into a top mount or other models. In general, the invention is only intended to be limited by the scope of the following claims.

We claim:

1. A refrigerator comprising:

a cabinet shell;

a liner arranged within the cabinet shell, said liner including top, bottom, rear and opposing side walls that collectively define a refrigeration compartment;

a door pivotally mounted to the cabinet shell for selectively closing the refrigeration compartment, said door including a top edge portion, a bottom edge portion and opposing side edge portions; and at least one dual hinge mechanism for selectively pivoting the door about a select one of first and second axes defined adjacent the opposing side edge portions, said dual hinge mechanism including:

a lock bar mounted to the bottom edge portion of the door, said lock bar including a first end portion and a second end portion joined by an intermediate portion, each of said first and second end portions including first and second lobe elements;

a hinge plate mounted to the cabinet shell below the door, said hinge plate including a first end section and a second end section joined by an intermediate section, each of said first and second end sections including a rudder member; and first and second hinge pins mounted to corresponding ones of the first and second end sections wherein, upon pivoting the door about a select one of the opposing side edge portions, one of the first lobe elements on one of the first and second end portions engages with the rudder member shifting the lock bar along the bottom edge portion of the door and causing the second lobe element of the other of the first and second end portion to interact with a corresponding one of the first and second hinge pins enabling the door to continue to pivot to an open position wherein the refrigeration compartment is exposed.

2. The refrigerator according to claim 1, further comprising: a plurality of rollers arranged on one of the bottom edge portion of the door and the hinge plate, said rollers selectively engaging an other of the bottom edge of the door and the hinge plate to provide support as the door transitions between open and closed positions.

3. The refrigerator according to claim 2, wherein the plurality of rollers are partially recessed into the bottom edge portion of the door.

4. The refrigerator according to claim 1, wherein each of the first and second hinge pins includes a pin portion and a guide track portion extending about part of the pin portion, said guide track portion cooperating with the second lobe element to trap the hinge pin thereby allowing the door to pivot about one of first and second axes defined by the first and second hinge pins respectively.

5. The refrigerator according to claim 4, further comprising: first and second hinge receivers provided in the bottom edge portion of the door, said hinge receivers being adapted to cooperate with the one of the first and second hinge pins to establish the one of the first and second axes.

6. The refrigerator according to claim 5, wherein the first and second hinge receivers are integrally formed in the bottom edge portion of the door outward of the first and second end portions of the lock bar.

7. The refrigerator according to claim 1, wherein the lock bar is slidably positioned in a channel provided in the bottom edge portion of the door.

8. The refrigerator according to claim 7, wherein the channel is integrally formed in the bottom edge portion of the door.

9. The refrigerator according to claim 1, wherein each of the first and second ends of the lock bar includes a rounded section, said rounded section being in contact with corresponding ones of the first and second hinge pins when the door is in a closed position.

10. The refrigerator according to claim 1, wherein said at least one dual hinge mechanism further comprises another dual hinge mechanism mounted to the top edge portion of the door.

11. The refrigerator according to claim 1, wherein the refrigerator is constituted by a bottom mount refrigerator having the refrigeration compartment arranged above a lower freezer compartment.

12. The refrigerator according to claim 1, wherein the hinge mechanism further includes first and second wedge members which cooperate with respective ones of the first and second lobe elements to center the lock bar upon closing of the door.

13. The refrigerator according to claim 12, wherein the first and second wedge members project from the hinge plate.

14. A method of selectively opening a dual swing refrigerator door mounted to a cabinet shell, said door having a top edge portion, a bottom edge portion and opposing side portions, about one of two pivot axes defined at the opposing side portions respectively comprising:

pivoting the door about the one of the pivot axes;

abutting a first lobe element provided on a first end of a lock bar with a rudder member provided on a first end of a hinge plate, said hinge plate being mounted to the cabinet shell and said lock bar being mounted to the bottom edge portion of the door;

shifting the lock bar along the bottom edge portion of the door through an interaction between the first lobe element and the rudder member;

engaging a second lobe element formed on a second end of the lock bar with a hinge pin provided at the second end of the hinge plate, said second lobe element trapping the hinge pin in a hinge pin receiver provided on said second end of the lock bar; and shifting the door to a fully open position about the one of pivot axes.

15. The method of claim 14, wherein the second lobe element passes into a guide track that partially extends about the hinge pin, wherein cooperation between the second lobe element and the guide track traps the hinge pin in the hinge pin receiver.

16. The method of claim 14, further comprising:

shifting the door to a closed position; and guiding the first and second lobe elements along respective first and second wedge members to center the lock bar in the bottom edge portion of the door upon closing the door.

17. The method claim 14, wherein the lock bar is shifted in a channel formed in the bottom edge portion of the door.

* * * * *